US006050885A

United States Patent [19]

Mörsch et al.

[11] Patent Number: 6,050,885

[45] Date of Patent: Apr. 18, 2000

[54] DEVICE FOR THE CHEMICAL-MECHANICAL POLISHING OF AN OBJECT, IN PARTICULAR A SEMICONDUCTOR WAFER

[75] Inventors: Georg Mörsch, Hamdorf; Thomas Keller, Osterrönfeld; Eberhard Potempka, Rendsburg, all of Germany

[73] Assignee: Peter Wolters Werkzeugmaschinen GmbH, Rendsburg, Germany

[21] Appl. No.: 09/072,663

[22] Filed: Apr. 27, 1998

[30] Foreign Application Priority Data

May 7, 1997 [DE] Germany ..... 197 19 503

[51] Int. Cl.[7] ..... B24B 29/00

[52] U.S. Cl. ..... 451/287

[58] Field of Search ..... 451/259, 5, 65, 451/66, 73, 287, 288

[56] References Cited

U.S. PATENT DOCUMENTS

| | | | |
|---|---|---|---|
| 5,547,415 | 8/1996 | Hasegawa et al. | 451/44 |
| 5,562,524 | 10/1996 | Gill, Jr. | 451/1 |
| 5,616,063 | 4/1997 | Okumura et al. | 451/1 |
| 5,618,227 | 4/1997 | Tsutsumi et al. | 451/288 |
| 5,679,059 | 10/1997 | Nishi et al. | 451/41 |
| 5,695,601 | 12/1997 | Kodera et al. | 156/636.1 |
| 5,827,110 | 10/1998 | Yajima et al. | 451/5 |
| 5,830,045 | 11/1998 | Togawa et al. | 451/288 |
| 5,885,134 | 3/1999 | Shibata et al. | 451/41 |

FOREIGN PATENT DOCUMENTS 0 761 387 A1 3/1997 European Pat. Off. .

195 44 328 A1 5/1996 Germany .

OTHER PUBLICATIONS

CMP Cluster Tool System Planarization Chemical Mechanical Polishing, Peter Wolters brochure, Mar. 1996.

*Primary Examiner*—Rocio Moreno
*Attorney, Agent, or Firm*—Vidas, Arrett & Steinkraus, P.A.

[57] ABSTRACT

A device for the chemical-mechanical polishing of the surface of an object, in particular of semiconductor wafers for the manufacture of semiconductors, with two polishing units with height-adjustable vacuum holders each for a semiconductor wafer, which can be driven by a drive motor about a vertical axis, parallel, approximately horizontally running guides, along which the polishing units are guided independently of one another, drive means by which the polishing units are moved along the guides, at least one polishing plate rotatingly driven below the guides, which is arranged approximately symmetrically on both sides of the longitudinal axes of the guides, by which means the polishing units in their corresponding operational position cooperate with oppositely lying sections of the polishing plate, at least one transfer and take-over device for the semiconductor wafer, at the end of the guides which is opposite to the polishing plate, two depositing and accommodating devices for the semiconductor wafer, which are arranged on oppositely lying sides of the guides and to which the polishing units can be aligned and which can be reached from the transfer and take-over device and a control device which controls the operation of the polishing units and of the transfer and take-over device.

9 Claims, 3 Drawing Sheets

DEVICE FOR THE CHEMICAL-MECHANICAL POLISHING OF AN OBJECT, IN PARTICULAR A SEMICONDUCTOR WAFER

BACKGROUND OF THE INVENTION

The invention relates to a device for the chemical-mechanical polishing of a surface of an object, in particular of semiconductor wafers according to the introductory part of claim 1.

Lapping or polishing machines, for example for manufacturing silicon wafers are conventionally constructed such that the subjects are accommodated by so-called runner disks which are arranged between the working disks of the lapping or polishing machine and by way of gear crowns or likewise are displaced in a cycloidal movement The application of such devices is not considered for the processing of finished wafers in the manufacture of semiconductors or chips.

As is known it is necessary that after each coating of a semiconductor wafer with a layer, for example with an oxide layer, a wolfram layer or other metal layers, a renewed processing must be carried out in order to get the desired planicity. This processing is normally effected in space-purity technology.

From DE 195 44 328 there is known a device for processing wafers in the semiconductor industry. According to this state of the art a housing is subdivided into a first and a second chamber, wherein in the first chamber there is arranged a polishing section and in the second chamber there is arranged a cleaning section. The transport of the one section into the other is effected with the help of a transfer device via an opening in the subdividing wall. Consequently in the housing differing purity spaces are created.

From the company document "CMP Cluster Tool System Planarization Chemical Mechanical Polishing " of Peter Wolters of March 1996 it is also known to arrange the polishing and cleaning stations together in a purity space and to separate the purity space from a space from which the semiconductor wafers are put into the purity space and are taken out from this with the help of a suitable transfer device. From this company document it is also known to provide two separate processing unit; to which in each case there is allocated a cleaning unit, wherein between the processing units there is arranged a transfer unit for the transfer to the processing and cleaning units and away from these. Such an arrangement requires relatively much space. The spacial requirement is further increased if under certain coating conditions a further polishing of the wafer in a second polishing station is required.

BRIEF SUMMARY OF THE INVENTION

It is the object of the invention to provide a device for the chemical-mechanical polishing of a surface of an object, in particular of a semiconductor wafer for the manufacture of semiconductors, which with a relatively high production quantity requires little space. In particular the device is to be in the position also with additional coatings, for example copper coatings, to manage a double-polishing without considerably higher expense.

This object is achieved by the features of patent claim 1.

With the device according to the invention there are provided two polishing units or polishing heads with a height-adjustable vacuum holder for a semiconductor wafer as well as a drive motor for rotating the vacuum holder and thus the semiconductor wafer. The mounting of the semiconductor wafer with the help of a height-adjustable vacuum holder (vacuum chuck) is known per se. Essential to the invention however is that the polishing units are adjustable along linear guides. For this there serves suitable adjusting means in order to move the polishing units along the guides. The polishing disk or the polishing plate is available to both polishing units in that each polishing unit only cooperates on one side of the guides with the polishing plate thereunder, i.e. each polishing unit during the polishing operation is allocated to one "half" of the polishing plate. As is known per se the polishing plate is set to rotate with the help of a suitable motor. In this context it is also known additionally to the rotations of polishing plate and vacuum holder to provide for an oscillating movement of the vacuum holder or the polishing head. If according to a further formation of the invention there are provided two polishing plates which are started up from the same subject by the polishing head after one another, then these lie in succession in the traversing direction of the polishing heads.

Additionally to the mentioned units at least one transfer and take-over device for the subjects are arranged on the end of the guides opposite to the polishing plate. This device which is also described as a transfer device is again known per se. Depositing and accommodating devices cooperate with the transfer and take-over devices, of which in each case one is arranged on opposite sides of the guides. The latter device is alternately charged by the transfer device or the transfer device alternately removes from this a semiconductor wafer which is completely processed., Furthermore the depositing and accommodating device in the case of wafers serves as a centering device so that the polishing units take over semiconductor wafers in a centered manner. This feature too is known per se.

By way of the described design of the device according to the invention there are obtained two parallel processing lines which can operate completely independently from one another. The use of space is particularly favourable since with one or two polishing plates in each case two polishing units may be applied, this being independently of one another. It is to be understood that the cycle speed may then be particularly high if the processing of the semiconductor wafers on a polishing plate is not effected simultaneously but displaced with respect to time.

According to one formation of the invention it is provided that on each side of the guides there is arranged a further rotatingly driven polishing plate with a diameter smaller than the first polishing plate and that between the first and the second or the third polishing plate there is arranged a cleaning station in which a semiconductor wafer and/or the polishing unit may be cleaned. Such a cleaning station is known per se. On the one hand it serves to remove polishing agent which still adheres to the semiconductor wafer and on the other hand to clean the polishing unit with other means if this is driven into the cleaning station without semiconductor wafers. The second or third polishing plate serves for completing the cleaning. This is effected mostly by the application of deionized water.

It is known to maintain the quality of polishing cloths or likewise in that with the help of suitable means, for example brushes or likewise, there is effected a napping. According to the invention it is provided for a planing device to be mounted on the guides for planing the polishing plate during the polishing operation. The planing device, for example a brush, may be radially moved to and fro with respect to the polishing plate in order to cause a desired napping.

If due to the above described technological reasons a further polishing plate is required, for example with a copper layering of semiconductor wafers, then according to one embodiment of the invention it is provided for the fourth polishing plate which e.g. has the same diameter as the first polishing plate, to be arranged between the first polishing plate and the depositing and accommodating device. Preferably with this the cleaning device is arranged between the polishing plates so that the subjects may be placed cleaned onto the second polishing plate.

BRIEF DESCRIPTION OF THE DRAWINGS

The invention is hereinafter decribed in more detail by way of the drawings.

DETAILED DESCRIPTION OF THE INVENTION

Figure 1:
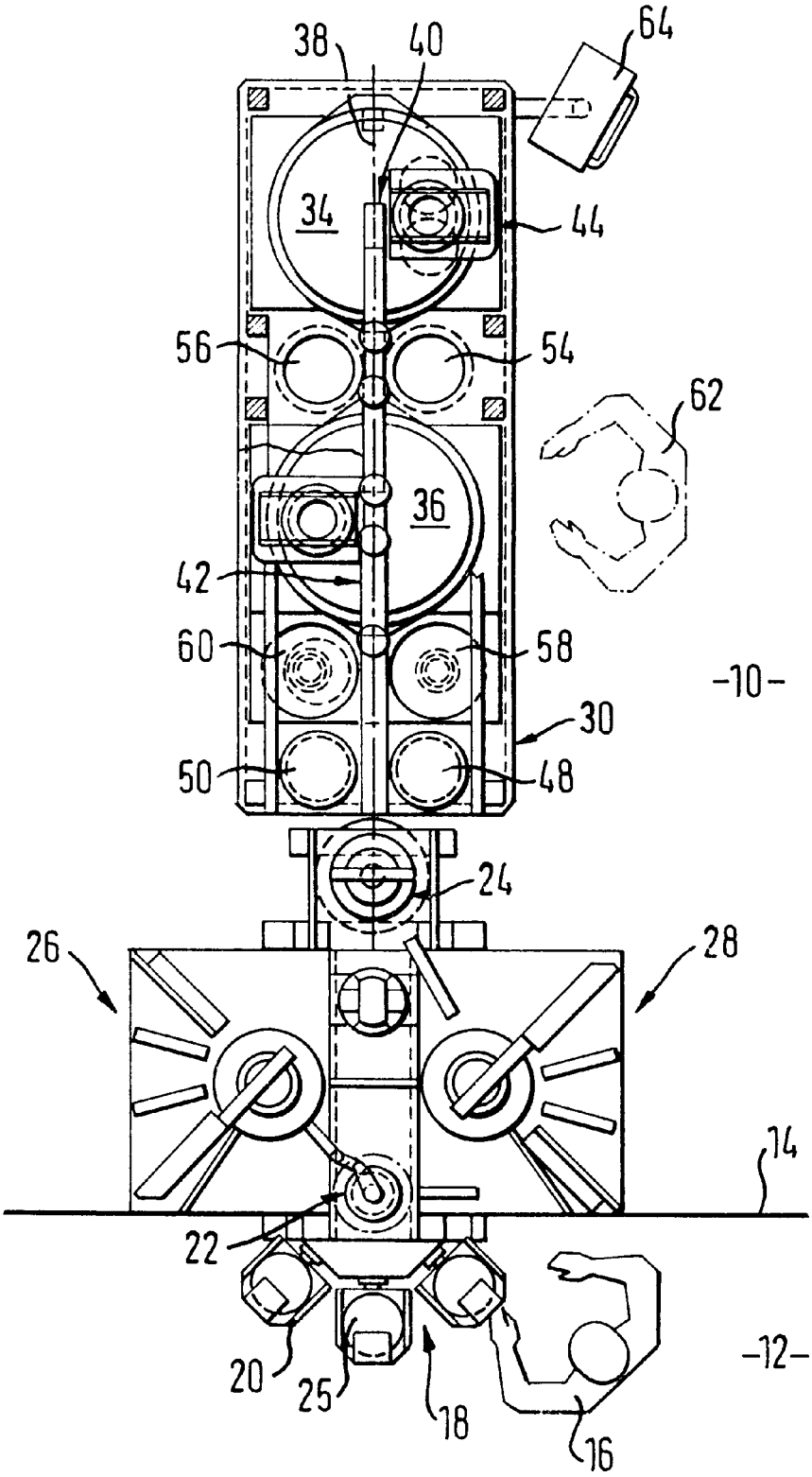
FIG. 1 shows a plan view of a schematically represented installation for processing semiconductor wafers with a device according to the invention.

In FIG. 1 a first space 10 is separated from a second space 12 by a wall 14. In the space 12 which may represent a purity space of a lower class, for example the class 1 there is an operating person 16 at a table which is suitable for accommodating cassettes 20. The cassettes 20 may in each case accommodate semiconductor wafers 25. Such a device is known per se.

A transfer device 22 which is located in the space 10, in a purity space e.g. of the class 100, and which is designed as a robot, is in the position to remove from a cassette 20 in each case the semiconductor wafer and to transfer this to a further transfer device 24. The transfer path is located between distanced cleaning stations 26, 28 whose functioning is dealt with later.

The transfer device serves for inputting the semiconductor wafers into a device indicated generally at 30. The device is described in more detail by way of FIG. 2.

In a machine frame of the device 30 indicated generally at 32 there are rotatably arranged about a vertical axis a first polishing plate 34 and a further polishing plate 36 distanced from one another. These are set into rotation by way of a suitable drive device (not shown). The plates 34, 36 are formed in the known manner and in particular comprise a polishing cloth or likewise. Furthermore a device for depositing a polishing medium is allocated to the polishing plates (not shown).

Figure 2:
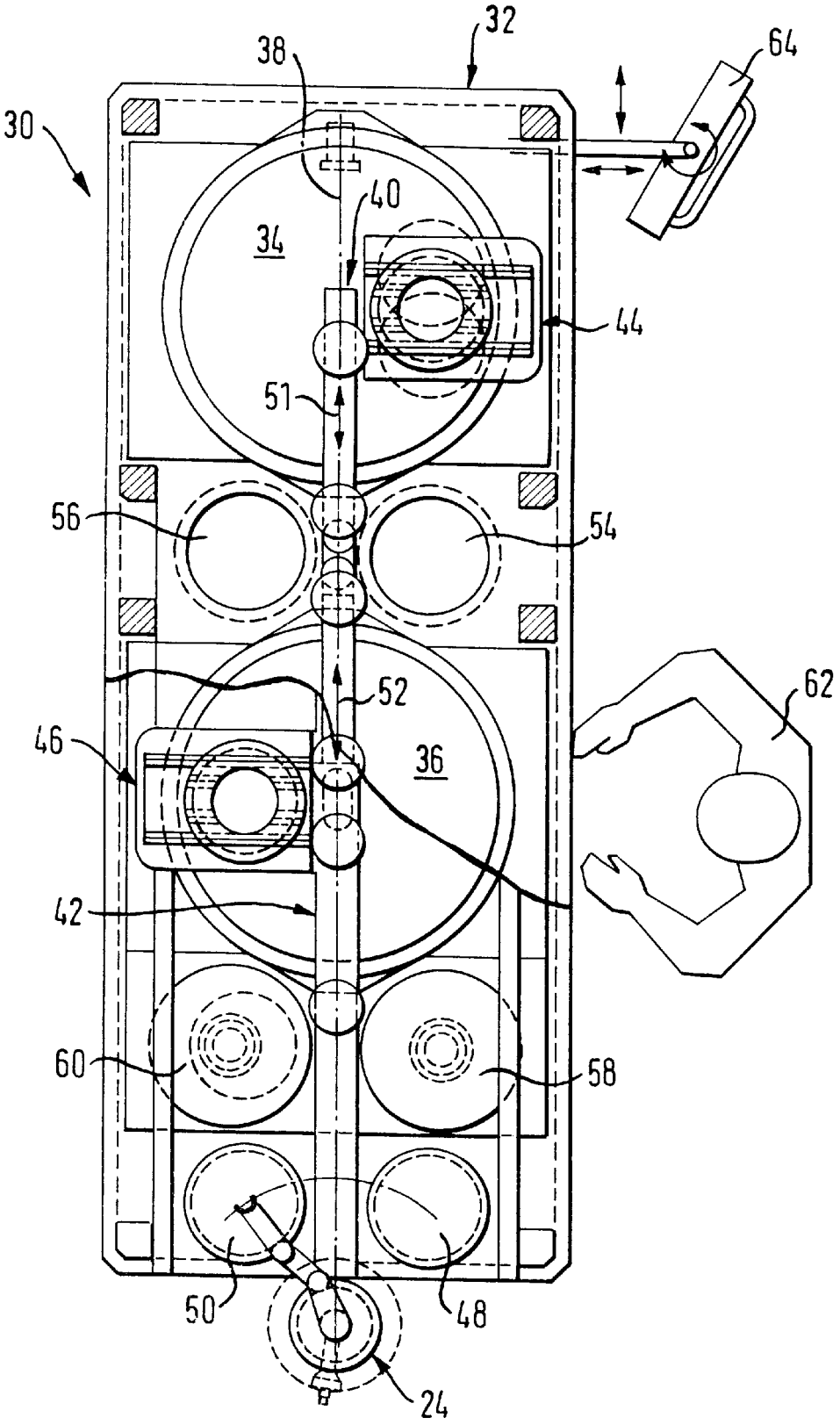
FIG. 2 shows enlarged the device according to the invention according to FIG. 1.

Above the axis 38 connecting the centre point of both polishing plates 34, 36 there is arranged a first linear guide. Above the first guide 40 there is arranged a second guide 42. Both extend slightly beyond the middle of the first polishing plate 34 (the latter guide 42 is shown in FIG. 2 partly broken away). On the first guide 40 a polishing unit 44 is guided in the longitudinal direction. The polishing unit 44 comprises a vacuum holder for a wafer (not recognizable), a drive motor for the holder as well as a linear adjustment possibility, e.g. a pneumatic cylinder, for the vertical adjustment of the vacuum holder towards and away from the polishing plate 34. Such a polishing unit 44 is however known per se. On the second guide 42 a polishing unit 46 is guided in the longitudinal direction of the guide. The polishing unit 46 is formed identically to the polishing unit 44 so that its description may be omitted. With the help of adjusting means which are not shown the polishing units 44, 46 independently of each other may be adjusted from the position in which the polishing unit 44 is shown to a position in which they are arranged above the accommodating and centering devices 48 or 50 at the lower end, in FIG. 2, of the device 30 on both sides of the guides 40, 42. The devices 48, 50 are again known per se. They serve the depositing of not yet processed or completed processed wafers as well their centering so that they may be accommodated by the vacuum holders of the polishing units 44, 46 in a position-orientated manner. By way of arrows 51, 52 planing means are indicated which are movable along the guide 40 for planing the polishing plates 34, 36, i.e. for conditioning or napping the polishing cloths of the plates 34, 36. The operation of the planing means is independent of the polishing processes so that this operation may proceed simultaneously with this.

Between the polishing plates 34, 36 on each side of the guides 40, 42 there is arranged a cleaning station 54, 56. Between the second polishing plate 36 and the depositing and accommodating devices 48, 50 there are arranged smaller polishing plates 58 and 60 respectively on both sides of the guides 40, 42. These are likewise rotatingly driven by a drive motor which is not shown.

An operating person is likewise assigned to the device 30, who is indicated at 62. The person may operate a control panel 64 which has various degrees of freedom as is indicated by the arrows so that it may be brought into various positions grasped by the operating person 62.

The operating manner of the device or installation according to FIGS. 1 and 2 is hereinafter described in more detail.

In the region of the space 10 the transfer device 22 removes a semiconductor wafer from a cassette and transfers it to the transfer device 24. This deposits the semiconductor wafer in the depositing and accommodating device 48 or 50. In this in the known manner there is effected a centering of the semiconductor wafer and a preparation for a polishing unit. In the present case it is assumed that a semiconductor wafer is deposited on the device 48 and is centered in this. The polishing unit 44 drives to the device 48 and its vacuum holder grasps the wafer disk from one side and transports it to the first polishing plate 34 on the right side of the guides 40, 42. By way of the sinking of the wafer on the polishing plate 34 there is then effected the processing in the already described manner. After this processing is ended after a certain time, predetermined by the control device (not shown), the polishing unit again lifts the wafer from the polishing plate 34 and transports the wafer to the cleaning station 54. In the cleaning station 54 the lower side of the wafer is cleaned from the residues of the polishing medium, this being in a mechanical manner with the help of brushes and/or deionized water. Such a cleaning station is known per se. From this the polishing unit 44 drives the wafer to the second polishing plate 36 in that a further and final polishing procedure is effected. The cleaning of the wafer after the first polishing procedure is also necessary so that a mixing of the polishing agent of the first polishing plate 34, which may still adhere to the wafer, may take place with the polishing agent of the polishing plate 36. A polishing procedure for the polishing plate 36 is shown in FIG. 2 for the polishing unit 46. After also the second polishing procedure is finished the polishing unit 44 drives the wafer to the polishing plate 58 which is only temporarily brought into engagement with the wafer and essentially has only a cleaning function. Subsequently the polishing unit 44 again drives the wafer to the depositing and accommodating device 48 and here deposits the wafer so that it may be grasped by the transfer device 24.

The transfer device 24 grasps the finished processed wafer and deposits it in the cleaning station 28 in which it goes through individual cleaning and drying steps. Such a system is likewise known per se and is not described in any detail. The finished cleaned and dried wafer is then grasped by the transfer device 22 and is inserted into a ready and waiting cassette 20 on the table 18.

After the polishing unit 44 has deposited the wafer it drives into the cleaning station 54 in which for its part it undergoes a cleaning before it again drives to the depositing and accommodating device 48 in order to accommodate a newly loaded wafer which is to be processed.

The procedures with respect to the polishing unit 46 are the same as described with respect to the polishing unit 44, wherein for the cycle of both polishing units a displacement of time is provided for in order to obtain an optimal throughput through the device, corresponding to the loading frequency.

Figure 3:
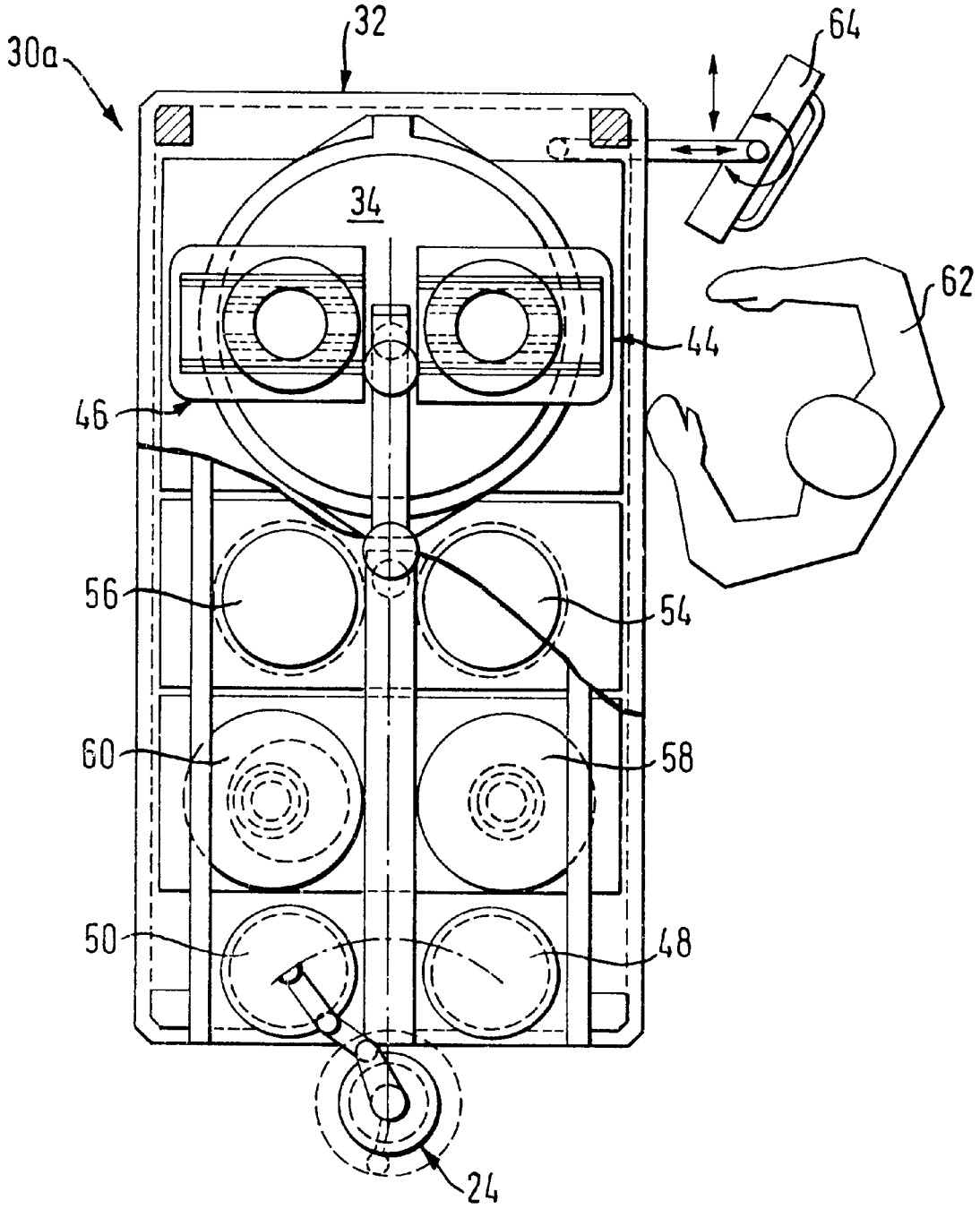
FIG. 3 shows another embodiment form of a device according to the invention.

The embodiment form according to FIG. 3 differs from that according to FIGS. 1 and 2 in that a device 30*a* is used which only comprises the first polishing plate 34 and not the second polishing plate 36 according to FIG. 2. As for the rest all devices or stations are identical with those according to FIG. 2 so that the same reference numerals are employed. Also the manner of functioning of the device 30*a* is the same as the above described device with the exception of the second polishing procedure. A repeated detailed description of this is therefore left out.

What is claimed is:

1. A device for the chemical-mechanical polishing of the surface of an object with two polishing units with height-adjustable vacuum holders each for a semiconductor wafer, which is driven by a drive motor about a vertical axis, parallel, approximately horizontally running guides, along which the polishing units are guided independently of one another, drive means by which the polishing units are moved along the guides, a first polishing plate rotatingly driven below the guides, which is arranged approximately symmetrically on both sides of the longitudinal axes of the guides, by which means the polishing units in their corresponding operational position cooperate with oppositely lying sections of the polishing plate, at least one transfer and take-over device for the semiconductor wafer, at the end of the guides which is opposite to the polishing plate, two depositing and accommodating devices for the semiconductor wafer, which are arranged on oppositely lying sides of the guides and to which the polishing units are aligned and which are reached from the transfer and take-over device and a control device which controls the operation of the polishing units and of the transfer and take-over device.

2. A device according to claim 1, wherein on each side of the guides a further rotatingly driven third and fourth polishing plates are arranged with a diameter smaller than the first polishing plate, and between the first polishing plate and the third or fourth polishing plate there is arranged a cleaning station in which a semiconductor wafer is cleaned.

3. A device according to claim 1, wherein on the guides there is guided a planing device for planing the first polishing plate during the polishing operation.

4. A device according to claim 1, wherein below the guides a further second rotatingly driven polishing plate of roughly the same diameter as the first polishing plate is arranged between the first polishing plate and the depositing and accommodating means in a manner such that the polishing units in their corresponding operational position cooperate with oppositely lying sections of the second polishing plate.

5. A method for operating the device according claim 1, wherein the polishing units bring the subjects into engagement with the first or fourth polishing plates displaced with respect to time.

6. A device according to claim 2, wherein the cleaning station is arranged between the first and the fourth polishing plate.

7. A device according to claim 4, characterised in that the second and the third polishing plates are arranged between the fourth polishing plate and the depositing and accommodating device.

8. A method according to claim 5, wherein the planing means during the polishing operation engage with the polishing plates in that the planing means are moved radially with respect to the rotational axis of the polishing plate.

9. A method according to claim 5, wherein the polishing units after depositing a subject in the depositing and accommodating device are driven to the cleaning station before the polishing units accommodate a new subject from the depositing or accommodating device.

* * * * *